United States Patent [19]

Honeyman

[11] Patent Number: 4,727,690

[45] Date of Patent: Mar. 1, 1988

[54] SCREED RAIL

[76] Inventor: Keith Honeyman, 67 Edison Drive, Meadowridge, Cape Town, South Africa

[21] Appl. No.: 937,308

[22] Filed: Dec. 3, 1986

[30] Foreign Application Priority Data

Dec. 3, 1985 [ZA] South Africa ..... 85/9260

[51] Int. Cl.[4] ..... E04B 1/41

[52] U.S. Cl. ..... 52/98; 52/127.5; 52/364

[58] Field of Search ..... 52/318, 127.5, 98–100, 52/611, 585, 726, 364, 367; 404/48, 64, 47

[56] References Cited

U.S. PATENT DOCUMENTS

| | | | |
|---|---|---|---|
| 2,011,531 | 8/1935 | Tranchell | 52/611 |
| 4,090,800 | 5/1978 | Koch | 404/48 |
| 4,576,510 | 3/1986 | Ljungkvist et al. | 404/47 |

FOREIGN PATENT DOCUMENTS

| | | | |
|---|---|---|---|
| 480259 | 2/1938 | United Kingdom | 404/43 |

OTHER PUBLICATIONS

Brochure entitled: "Tremix System".
Brochure entitled: "For the Job Superintendent . . . Permaban Screed Rails".
Brochure entitled: "Permaban—Kvarsittande Avdragsbanor i Betong".
Brochure entitled: "Permaban—Leave-in-place Screed Rail—Specifications Guide" (Sep. 84).
Brochure entitled: "Tremix Treform".

*Primary Examiner*—James L. Ridgill, Jr.
*Attorney, Agent, or Firm*—Willian Brinks Olds Hofer Gilson & Lione Ltd.

[57] ABSTRACT

A prefabricated leave-in-place screed rail for use in forming a floor or pavement slab of slab material cast on opposite sides of the screed rail so that the slab material forms a bond with each side of the screed rail, has an upwardly open groove extending along the rail between the sides. The groove provides for preferential cracking of the screed rail upon shrinkage of the slab material. The screed rail has a toughened upper layer adjacent each opposite side of the groove, and a sealant in the groove.

11 Claims, 2 Drawing Figures

SCREED RAIL

FIELD OF THE INVENTION

THIS INVENTION relates to a screed rail. More particularly it relates to a prefabricated leave-in-place screed rail for use in forming a floor or pavement slab of slab material cast on opposite sides of the screed rail.

SUMMARY OF THE INVENTION

According to the invention there is provided a prefabricated leave-in-place screed rail for use in forming a floor or pavement slab of slab material cast on opposite sides of the screed rail so that the slab material forms a bond with each said side of the screed rail, the screed rail having an upwardly open groove extending along the rail between said sides, thereby to provide for preferential cracking of the screed rail along the groove upon shrinkage of the slab material.

The groove may have a depth of between one third and two thirds the height of the rail.

The screed rail may comprise an upper layer adjacent each opposite side of the groove, the upper layer being of a tough material which is resistant to spalling or chipping.

Each side of the rail may have key formations therein for assisting in the formation of said bond with the slab material.

The screed rail may have a relatively wide base and a relatively narrow top, said key formations being provided by each side of the rail having an at least partly upwardly facing jagged surface between the base and the top.

Each side of the rail may be provided with fast reinforcing elements which are partly embedded in, and protrude laterally from, the respective side of the rail. The protruding parts of the first reinforcing elements will then become embedded in the slab material, thus enhancing the bond between the rail and the slab material.

The screed rail may have second reinforcing elements embedded therein below the groove, the second reinforcing elements extending from one side of the rail to the other.

The second reinforcing elements may be treated with a bond breaking material so as to prevent a strong bond being formed between the second reinforcing elements and the rest of the screed rail.

The groove may contain a plastically or resiliently deformable sealant.

The rail may have, at two opposite ends thereof, complementary locating formations for locating one such rail laterally with respect to another such rail when the rails are arranged in end-to-end adjoining relationship with the complementary locating formations engaging with one another.

The locating formation at one end of the rail may comprise one or more dowels protruding from that end, in which event the locating formation at the other end may comprise one or more complementary holes for receiving the dowels of an adjoining such rail.

The invention will now be described in more detail, by way of example, with reference to the accompanying drawings.

DETAILED DESCRIPTION OF PREFERRED EMBODIMENT

Figure 1:
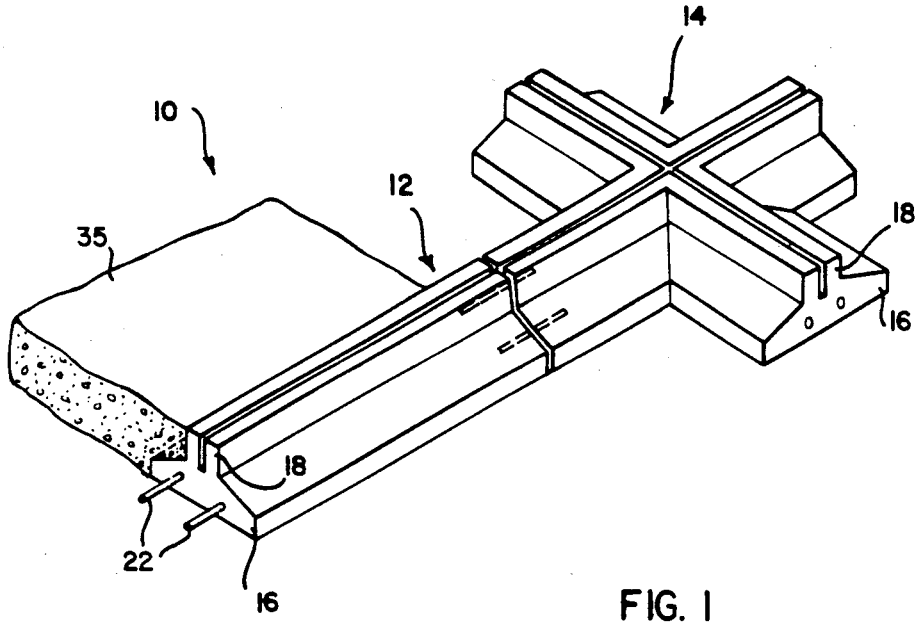
FIG. 1 is a cut-away, three dimensional view of part of a concrete floor slab including screed rails in accordance with the invention.

Referring now to the drawings in more detail, reference numeral 10 generally indicates a cast concrete floor slab. The floor slab is formed as follows. First, the underlying surface 11, which may be formed by bare soil or concrete blinding, is levelled and a number of prefabricated concrete screed rails 12 then placed on the surface. The screed rails 12 are preferably arranged in a number of parallel rows (not shown). However, they may also be placed along intersecting lines, a cruciform screed rail 14 being in that event used at each intersection. As an alternative to the cruciform screed rails 14, screed rails (not shown) which are similar to the screed rails 12, except that they have one end thereof formed into a 90° point may be used. Four of such rails with their pointed ends meeting would then be equivalent to the rail 14. Such rails with a pointed end may be made by placing an appropriate insert at the one end of a mould used to make the rails 12. This will avoid having to provide a separate mould such as would be required to make the cruciform screed rails 14.

The screed rails have a relatively broad base 16 and a relatively narrow top 18, and their height is equal to the required thickness of the floor slab which is to be formed. Between the base 16 and the top 18, on each side of the rail, there is a jagged, partly upwardly facing surface 20. At one end of the rail there are a pair of protruding steel dowels 22 and at the other end a pair of complementary holes 24. These serve to locate adjacent screed rails with respect to one another, the dowels 22 of one rail entering the holes of the adjoiing rail. Furthermore, there are transversely extending steel rods 26 embedded in the base 16. These may be coated with an oily substance or other bond breaking material so as to prevent the cement of the concrete from forming a strong bond with the rods 26. If desired, further reinforcing 28 may be embedded in the screed rail, this not being treated with bond breaking material, the reinforcing 28 protruding laterally from the screed rail.

Along the top of the screed rail there is an upwardly open groove 30 which extends the entire length of the rail, the groove being filled with a suitable sealant 32. As will be seen in FIG. 2, the groove has a depth which is slightly less than half the height of the rail. The sealant may be injected into the groove at the factory. Alternatively, the sealant can be injected into the groove afterwards, for example after the slab has been cast.

The screed rails 12, 14 may conveniently be produced by casting them upside down in a mould. In other words, the groove will be formed by an upstanding ridge extending upwardly from the bottom of the mould.

If desired, a special material such as that available in the trade as "Masterplate" may be poured into the mould before the concrete is added, so as to form a layer 34 at the bottom of the mould. The special material is able to form a good bond with the subsequently added concrete and, when set, forms a relatively tough layer which will resist spalling or chipping at the corners.

Once the screed rails 12, 14 have been laid out on the supporting surface in the desired arrangement, concrete 35 is cast into the spaces between them, until the concrete is level with the upper surfaces of the rails. The surface is then floated manually or by machine and the concrete allowed to set.

The upwardly facing jagged surfaces 20 and the protruding reinforcing 28 will assist in forming a bond between the concrete and the screed rails 12, 14 the surfaces 20 acting as key formations. If desired, before the concrete is cast into the spaces between the screed rails 12, 14 the surfaces of the rails which will come into contact with the wet concrete 35 may be treated with a suitable wet-to-dry concrete bonding agent so as to improve further the bonding between the concrete 35 and the screed rails.

Figure 2:
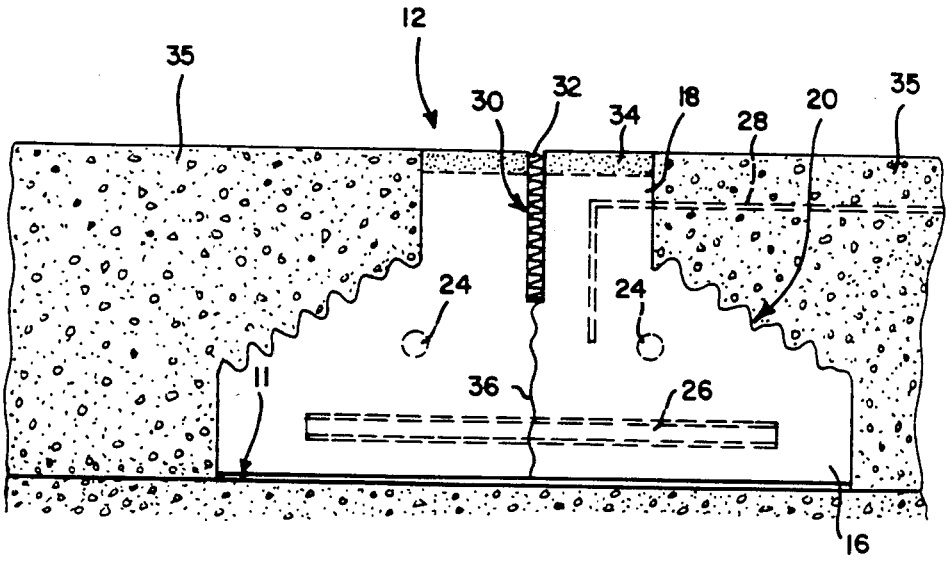
FIG. 2 is a vertical section through part of the floor slab.

By using screed rails as described above, shrinkage cracking as indicated by reference numeral 36 in FIG. 2 will occur preferentially along the grooves 30. When cracking has occurred, the slab portions on opposite sides of the screed rail remain bonded to the corresponding sides of the screed rail 12, the groove and crack (and the bond breaking material on the reinforcing rods 26) permitting relative movement between the slab portions to take place. Provided the relative movement remains within limits, seepage of water through the crack 36 will be prevented by the sealant 32.

What is claimed is:

1. A prefabricated leave-in-place screed rail for use in forming a floor or pavement slab of slab material cast on opposite sides of the screed rail so that the slab material forms a bond with each said side of the screed rail, the screed rail having an upwardly open, downwadly closed groove extending along the rail between said sides, thereby to provide for preferential cracking of the screed rail along and below the groove upon shrinkage of the slab material.

2. A screed rail according to claim 1, wherein the groove has a depth of between one third and two thirds the height of the rail.

3. A screed rail according to claim 1, which comprises an upper layer adjacent each opposite side of the groove, the upper layer being of a tough material which is resistant to spalling or chipping.

4. A screed rail according to claim 1, wherein each side of the rail is provided with first reinforcing elements which are partly embedded in, and protrude laterally from, the respective side of the rail.

5. A screed rail according to claim 1, wherein the groove contains a plastically or resiliently deformable sealant.

6. A screed rail according to claim 1, wherein each side of the rail has key formations therein for assisting in the formation of said bond with the slab material.

7. A screed rail according to claim 6, which has a relatively wide base and a relatively narrow top, and wherein said key formations are provided by each side of the rail having an at least partly upwardly facing jagged surface between the base and the top.

8. A screed rail according to claim 1, which has second reinforcing elements embedded therein below the groove, the second reinforcing elements extending from one side of the rail to the other.

9. A screed rail according to claim 8, wherein the second reinforcing elements are treated with a bond breaking material.

10. A screed rail according to claim 1, the rail having two opposite ends, and the ends being provided with complementary locating formations for locating one such rail laterally with respect to another such rail when the rails are arranged in end-to-end adjoining relationship with the complementary locating formations engaging with one another.

11. A screed rail according to claim 10, wherein the locating formation at one end comprises one or more dowels protruding from that end, and wherein the locating formation at the other end comprises one or more complementary holes for receiving the dowels of an adjoining such rail.

* * * * *

UNITED STATES PATENT AND TRADEMARK OFFICE

CERTIFICATE OF CORRECTION

PATENT NO. : 4,727,690

DATED : March 1, 1988

INVENTOR(S) : Honeyman

It is certified that error appears in the above-identified patent and that said Letters Patent is hereby corrected as shown below:

In column 1, line 35, please delete "fast" and insert therefor -- first --.

In column 2, line 38, please delete "adjoiing" and insert therefor -- adjoining --.

In column 2, line 57, after the word "groove" please insert -- 30 --.

In column 3, line 33, please delete "downwadly" and insert therefor -- downwardly --.

Signed and Sealed this

Thirteenth Day of December, 1988

*Attest:*

DONALD J. QUIGG

*Attesting Officer*

*Commissioner of Patents and Trademarks*